US006287126B1

(12) United States Patent
Berger et al.

(10) Patent No.: US 6,287,126 B1
(45) Date of Patent: Sep. 11, 2001

(54) MECHANICAL ATTACHMENT MEANS USED AS ELECTRICAL CONNECTION

(75) Inventors: Michael Berger, New Paltz; Lewis S. Goldmann, Bedford; Harvey C. Hamel, Poughkeepsie; Mario J. Interrante, New Paltz; Marlene W. Moyer; Thomas P. Moyer, both of Lagrangeville; Karl J. Puttlitz, Sr., Wappingers Falls, all of NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/344,887

(22) Filed: Jun. 25, 1999

(51) Int. Cl.[7] ..... H01R 12/00
(52) U.S. Cl. ..... 439/66; 439/65
(58) Field of Search ..... 439/65, 66, 74, 439/284, 291, 371, 507, 676

(56) References Cited

U.S. PATENT DOCUMENTS

| | | | |
|---|---|---|---|
| 3,585,569 | 6/1971 | Moran | 439/371 |
| 4,239,046 | 12/1980 | Ong | 128/640 |
| 4,589,585 | 5/1986 | Long, Jr. | 228/119 |
| 4,988,305 | 1/1991 | Svenkeson et al. | 439/65 |
| 5,059,128 | 10/1991 | Murphy et al. | 439/65 |
| 5,230,632 * | 7/1993 | Baumberger et al. | 439/66 |
| 5,299,939 | 4/1994 | Walker et al. | 439/74 |
| 5,694,296 | 12/1997 | Urbish et al. | 361/774 |
| 5,774,341 * | 6/1998 | Urbish et al. | 361/774 |
| 5,926,951 * | 7/1999 | Khandros et al. | 29/843 |
| 6,044,548 * | 4/2000 | Distefano et al. | 29/840 |
| 6,140,581 * | 10/2000 | Cowan et al. | 174/52.4 |

FOREIGN PATENT DOCUMENTS 5273394 6/1977 (JP) .

* cited by examiner

*Primary Examiner*—Brian Sircus
*Assistant Examiner*—Michael C. Zarroli
(74) *Attorney, Agent, or Firm*—Margaret A. Pepper; John A. Jordan

(57) ABSTRACT

An electrical connector arrangement for connecting electronic devices to one another. The connector arrangement uses tensile members and compression members, at least the tensile members of which act to provide both an electrical connection between electronic devices and force over a range of distances to hold the devices together. The tensile members provides tensile force acting to hold the electronic devices together while the compression members provide an opposing compressive force over a range of distances which balances the tensile force to thereby form a cellforce connector used to connect an array of electrical contact points on one electronic device to a corresponding array of electrical contact points on another electronic device.

48 Claims, 3 Drawing Sheets

MECHANICAL ATTACHMENT MEANS USED AS ELECTRICAL CONNECTION

BACKGROUND OF THE INVENTION

1. Field of the Invention

The present invention relates to electrical connections. More particularly, the present invention relates to electrical connection means using mechanical structural elements which act to provide both electrical connections and balanced structural attachment forces between electronic components.

2. Background and Related Art

Various techniques exist in the prior art for making electrical connections between electronic components. These techniques typically use solder ball or solder column connections, wire bond pads or pin arrangements. Solder ball and solder column connections are known to have fatigue limitations. Fatigue limitations further limit the size of substrate that can be used for solder ball or solder column connections. Solder ball and solder column connections also have limitations because of the amount of space they require.

Pin arrangements, likewise, have space limitations. For example, the connectors to which the pins are attached utilize flexed metal compression bits as pin sockets. Such structure, in itself, requires a relatively large amount of space and additional space must also be allocated for the flexing movement upon pin insertion. Moreover, these pin sockets are typically soldered into the next level of assembly, using additional space for holes and/or surface lands.

Other forms of connectors, particularly when configured in large arrays, require application of a relatively large amount of force necessitating mechanical support structure which is bulky, cumbersome and costly.

In addition to the solder and pin connection techniques described above, various other connector techniques have been developed for connecting electronic components.

For example, U.S. Pat. No. 5,299,939 to Walker et al describes a spring array connector for interconnecting electronic components and circuit boards. This spring array connector requires a continuous application of an engaging force to maintain connection.

U.S. Pat. No. 3,585,569 to Moran describes a contact connector within a protective enclosure. The connector of Moran also requires continuous application of an engaging force to maintain a single electrical connection. Such force is provided by either an adhesive or hook-and-loop fastening system.

Another example of prior art connector techniques is that described in U.S. Pat. No. 4,239,046 to Ong. Ong describes an electrode connection arrangement for medical electronic devices which may easily be disconnected. To do this Ong also uses a hook-and-loop fastening system for making a single electrical connection.

Japanese patent JP52073394 to Akiyama describes a connector arrangement for use in a liquid crystal display. Application of engaging force to maintain a single electrical connection is provided in one embodiment by a hook-and-loop type fastening system.

U.S. Pat. No. 5,694,296 to Urbish et al describes a multipoint electrical connector having deformable J-hooks. A continuous external engaging force is required in Urbish et al to, again, makes but a single electrical connection.

U.S. Pat. No. 4,988,305 to Svenkeson et al and U.S. Pat. No. 5,059,128 to Murphy et al each describe a high density pin connector arrangement using "floating ring" engagers adapted to resiliently couple pairs of mating pins together.

The difficulty with these later examples of connectors resides in the fact that they either require the application of an external engaging force, are designed for a single connection or their inherent structure necessitates utilization of too much space to meet today's requirements for density of connectors.

SUMMARY OF THE INVENTION

In accordance with the teachings of the present invention, a high density electrical connection arrangement is provided using connection structure elements which act to provide both the electrical connection between respective points of opposing arrays of connection points of electronic components and the structural support to hold the opposing arrays in continuous electrical connection. One set of connection structure elements acts to provide tensile force to its opposing arrays of connection points of electronic components while another set of connection structure elements acts to provide compression force to its opposing arrays of connection points of electronic components.

The connection structure elements are of a shape and have mechanical properties which provide balanced forces at an equilibrium distance between the opposing arrays of connection points of electronic components. The balanced forces are large enough that electrical contact is maintained when the electronic components being joined are subjected to different orientations, impact shocks and vibrations consistent with electronic component usage. The elements are able to provide force sufficient to maintain electrical contact at distances which vary over a range larger than the variations in the heights of individual elements, combined with the variation in the heights of the connection points of the electronic components being joined, further combined with the variation in component-to-component distance which results when the electronic components are subjected to different orientations, impact shocks, and vibrations consistent with electronic component usage.

The connection structure elements that provide tensile force are of a shape which allows the elements of one opposing array to engage with or latch the corresponding tensile elements of the other opposing array. Such shapes may be provided, for example, by hook-to-hook and hook-to-loop type structures. The connection structure elements that provide compressive force are of a shape to create compressive forces sufficient to offset the tensile forces. The connection structure elements that provide the tensile and compressive forces are comprised of one or more shaped elements attached to or formed as an integral part of one of the electronic components to be joined or in contact with one or more shaped elements or contact pads attached to or formed as an integral part of the other electronic component.

Accordingly, it is an object of the present invention to provide a high density electrical connection arrangement.

It is a further object of the present invention to provide a high density electrical connection array having individual connection means which will not fatigue.

It is another object of the present invention to provide a high density electrical connection array which may be readily assembled or disassembled at room temperature.

It is another object of the present invention to provide a high density electrical connection array which may be reassembled after having been disassembled.

It is yet another object of the present invention to provide a high density electrical connection array which has a relatively high initial external engagement force for assembly but no external force to continue connection after assembly.

It is yet a further object of the present invention to provide a high density electrical connection array which utilizes simple connection structure elements some of which connection structure elements act to provide tensile force to hold opposing connection surfaces engaged while other connection structure elements act to provide compression force to balance the tensile force and maintain continuous electrical connection.

The foregoing and other objects, features and advantages of the invention will be apparent from the following more particular description of a preferred embodiment of the invention, as illustrated in the accompanying drawing wherein like reference numbers represent like parts of the invention.

DETAILED DESCRIPTION

Figure 1:
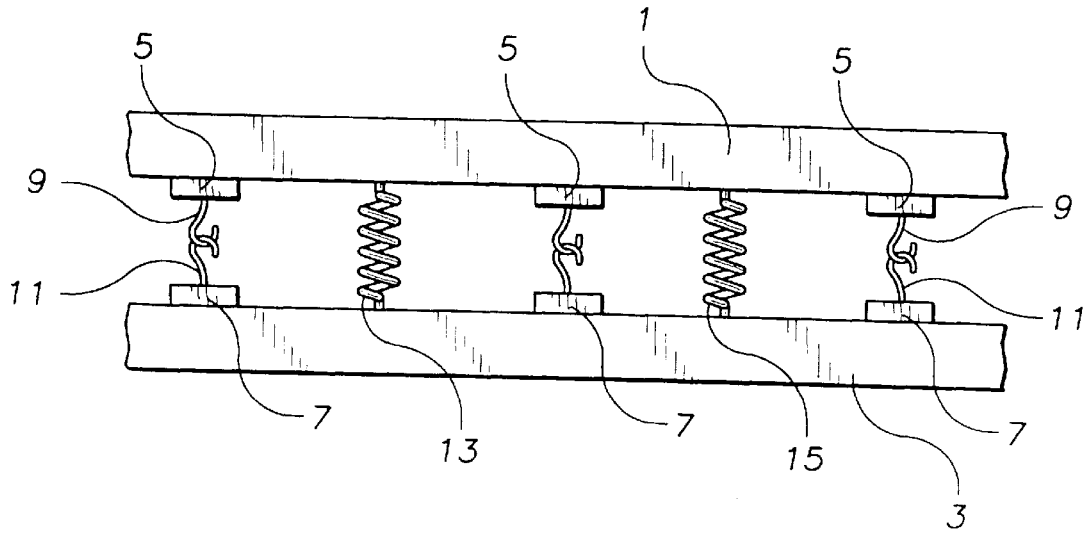
FIG. 1 shows a side view of one arrangement of an embodiment of the present invention wherein a hook-type structure is used as a tensile force member and a helical-type structure is used as a compression force member.

With reference to FIG. 1, there is shown a side view of a section of connected substrates 1 and 3. As can bee seen, each of the conductive contact pads 5 on substrate 1 are respectively connected to conductive contact pads 7 on substrate 3 by respective pairs of conductive hooks 9 and 11, which act as tensile elements. Each of the hooks 9 and 11 of the hook-pairs are mechanically coupled together, as shown, to provide tensile force holding substrates 1 and 3 together. Conversely, helical compressive elements 13 and 15 provide compressive force to hold substrates 1 and 3 apart so that the hook portions of hooks 9 and 11 stay tightly engaged to provide good conductive contact.

In this regard it should be noted that, in accordance with the present invention, tensile elements are chosen to impose force over the range of distances required. This may be achieved by construction of the tensile hooks or loops, for example, or both, from material having the ability to elastically deform. Imposition of force over the range of distances required may also be achieved by using a relatively undeformable engaging shape attached to an elastically deformable shape. In this regard, some of the shapes commonly used for springy portions of tensile springs are a helix, C shapes, J shapes, loops, cantilever beams, cantilever rods, cupped disks and bumper membranes.

The structures used for the connection structure elements that provide compressive force may be any of the shapes known to those skilled in the art for forming compressive springs. The same shapes available for the springy portion of the connection elements that provide tensile force may be used for the springy portion of the connection elements that provide compressive force.

The connection elements that provide compressive force may alternately be an elastic polymer such as silicone rubber, latex rubber, butvar, or viton. The elastic polymer may further be individual elements, or a sheet with openings through which the conductive elements that provide tensile force, pass. In the instance wherein a perforated sheet of elastic polymer is used, the ability of the sheet to compress to different degrees in the locality of individual elements which provide tensile force, causes these localities to act as elements providing force over the distances required to be consistent with the teachings of the present invention.

Although opposing ends of helical compressive spring elements 13 and 15 in FIG. 1 are shown directly connected to respective substrates 1 and 3 so as to provide only mechanical support, each of these ends could also be connected to conductive contact pads to provide additional electrical connections between substrates. However, since the helical configuration of the springs would add excessive inductance to the connection, most applications would suggest that the helical spring elements shown here be used only for mechanical purposes.

Thus, the connection elements that provide compressive forces may comprise one or more shapes in contact with or attached to or formed as an integral part of one of the electronic components to be joined and/or one or more shapes in contact with or attached to or formed as an integral part of the other electronic component to be joined. Where the elements which provide compressive force are not mechanically attached to either of the electronic components to be joined, as shown, for example, in FIG. 1, a nonconductive frame or membrane or housing may be used to hold the elements in alignment to the arrays of electrical contact points.

With reference to FIG. 1, substrates 1 and 3 may be made of any of a variety of conventional ceramic substrate materials used for electronic packaging. In addition, the substrates could support many chips in a multichip module configuration or one chip in a single chip module configuration. The substrates could be made of any of a variety of conventional a polymeric substrate material used for electronic packaging. Alternatively, one of the substrates could be a chip itself or a full wafer of chips with hooks used to connect the chips to the remaining substrate. In addition, one or both of the substrates could be a printed circuit board with hooks used to connect the chip carrying packages to the board.

Hooks may be made from any of a variety of metals, typically round metal wire. Present day wire bond equipment used in electronic packaging may be used to connect the hooks to the substrate. It should be appreciated that FIG. 1*a* is shown to depict the manner in which compressive and tensile elements are used for the dual purpose of mechanically holding the electronic components together without external attachment means and, at the same time, providing electrical connection at appropriate connection points. Any of a variety of sizes, shapes, spacing and materials could be used for these elements.

For example, gold, tungsten or molybdenum wire could be used for hooks 5 and 7. Tungsten would provide good stiffness and may be coated with nickel and then gold to provide good electrical connection. Gold coated copper wire may also be used, as well as precipitated hardened copper and phosphor bronze. Superelastic nickel-titanium alloys provide a greater amount of resilient deformation. Noble metal coatings may be applied to the surface of superelastic nickel-titanium alloy shapes to provide good electrical connection. The type of wire selected may vary with the particular application, i.e., chip-to-chip, chip-to-substrate substrate-to-substrate or module-to-board or board-to-board. The size of a wire, i.e. diameter, will also vary depending upon the material used, the particular application and the metallurgy used for the conductive contact points. The size and the ratio of height to width will also vary for connection structure elements made of substantially rectangular cross-section conductive material.

Figure 2:
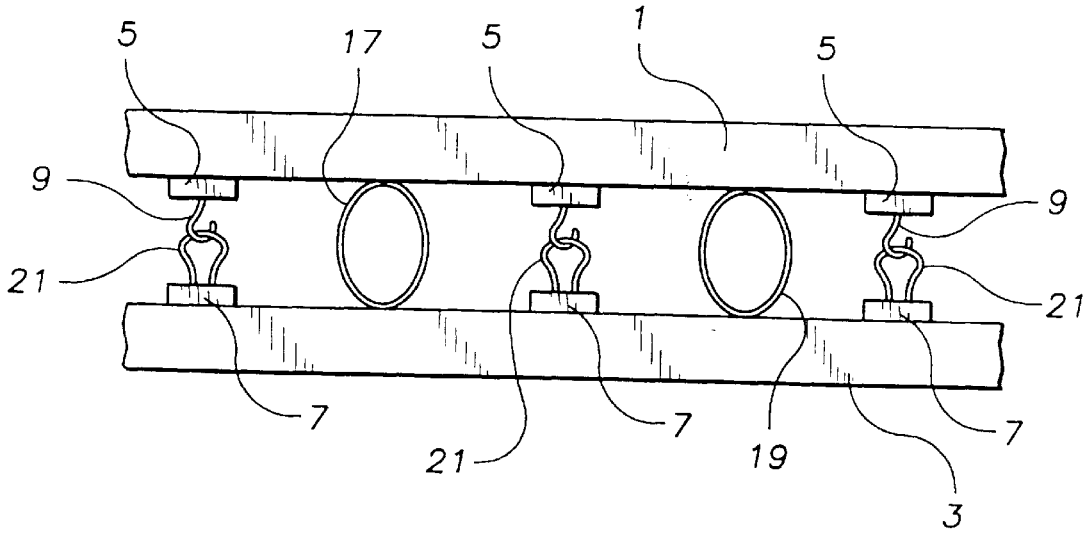
FIG. 2 shows a side view of another arrangement of an embodiment of the present invention wherein a hook-and-loop structure is used as as tensile force member and a loop-type structure is used as a compression force member.

FIG. 2 shows a variation of the arrangement shown in FIG. 1 wherein helical spring elements 13 and 15 are replaced by compressive wire loop elements 17 and 19. Any of a variety of controlled shapes may be used for loop elements 17 and 19 as long as upon compression it offers sufficient return force to act as a compressive spring and hold hooks 9 tight against omega-shaped loops 21. In this regard, the term "loop" is intended to mean any shape which has a resilient curvature which acts as a compressive spring element. Likewise, loops 21, used in place of hooks 11 in FIG. 1, may be any of a variety of shapes as long as it offers sufficient stiffness and compliance to keep hooks 9 engaged with loops 21.

Loops 21 with hooks 9 in FIG. 2 act in the same manner as hooks 9 and 11 in FIG. 1 to provide an electrical connection between pads 5 and 7. Structurally, however, loops 21 are conductively connected to pads 7 at two points. This connection may be done by wire bonding, soldering, brazing or welding depending upon the wire material used, its size, i.e. diameter of the wire, density of contact points and metallurgy to which it is attached.

Although not shown, compressive loops 17 and 19 in FIG. 2 may also act as conductive connectors between substrates 1 and 3. Connection of loops 17 and 19 to contact pads may be made in the same manner as was described with respect to hooks 9. Again, in similar manner as was described with respect to FIG. 1, the electrical connectors shown in FIG. 2 could be used to connect chip-to-chip, chip-to-substrate substrate-to substrate or module-to-board or board-to-board.

Figure 3A:
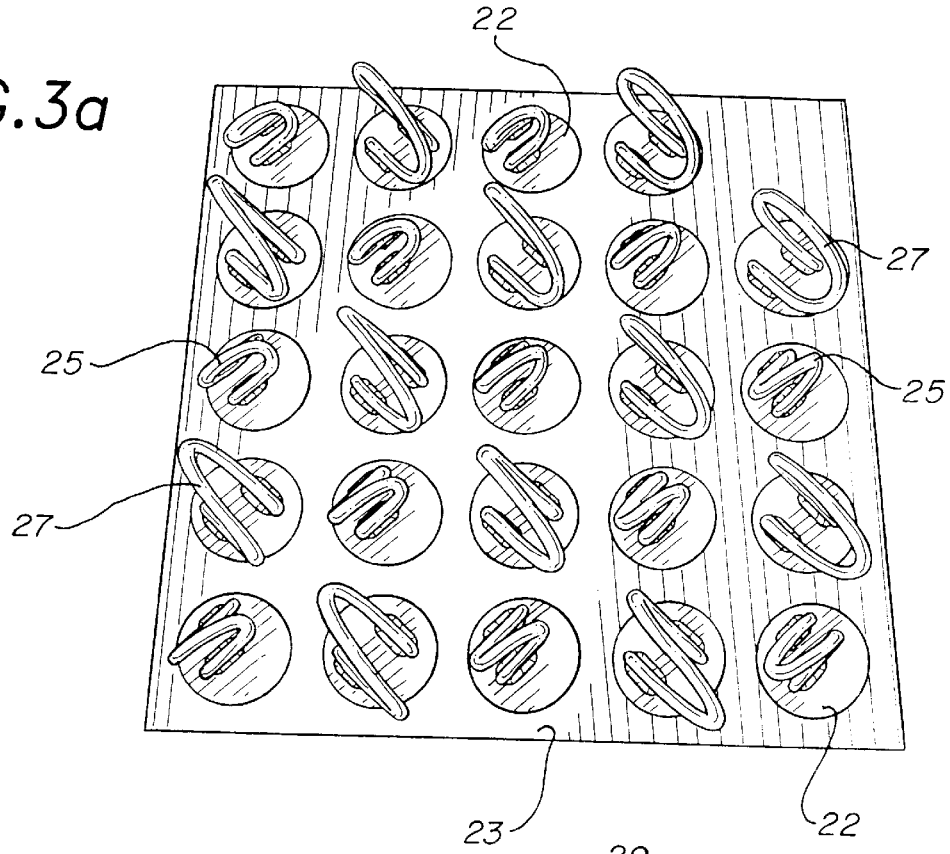
FIG. 3*a* shows a top perspective view of a two-dimensional array of wire loops on a substrate.

FIG. 3*a* shows a top perspective of an array of conductive wire loops mounted on electrical contact pads 22 on substrate 23. As can be seen, the array has two sizes of loops. The smaller loops 25 are positioned orthogonal to larger loops 27 in alternate rows. The height of loops 25 is about half the height of loops 27 with loops 27 acting as the compressive force members when an opposing substrate is positioned over substrate 23 and depressed and engaged, as will be explained further with regard to FIG. 3*b*. As also can be seen, both loops 25 and 27 are somewhat elliptical in shape when viewed from the side into the plane of substrate 23. This elliptical shape in larger loops 27 acts to provide good resilience or spring back force when compressed by an opposing substrate, and yet in the smaller loops 25 this shape provides good tensile strength as well as good resilience when engaged with a hook on an opposing substrate.

Figure 3B:
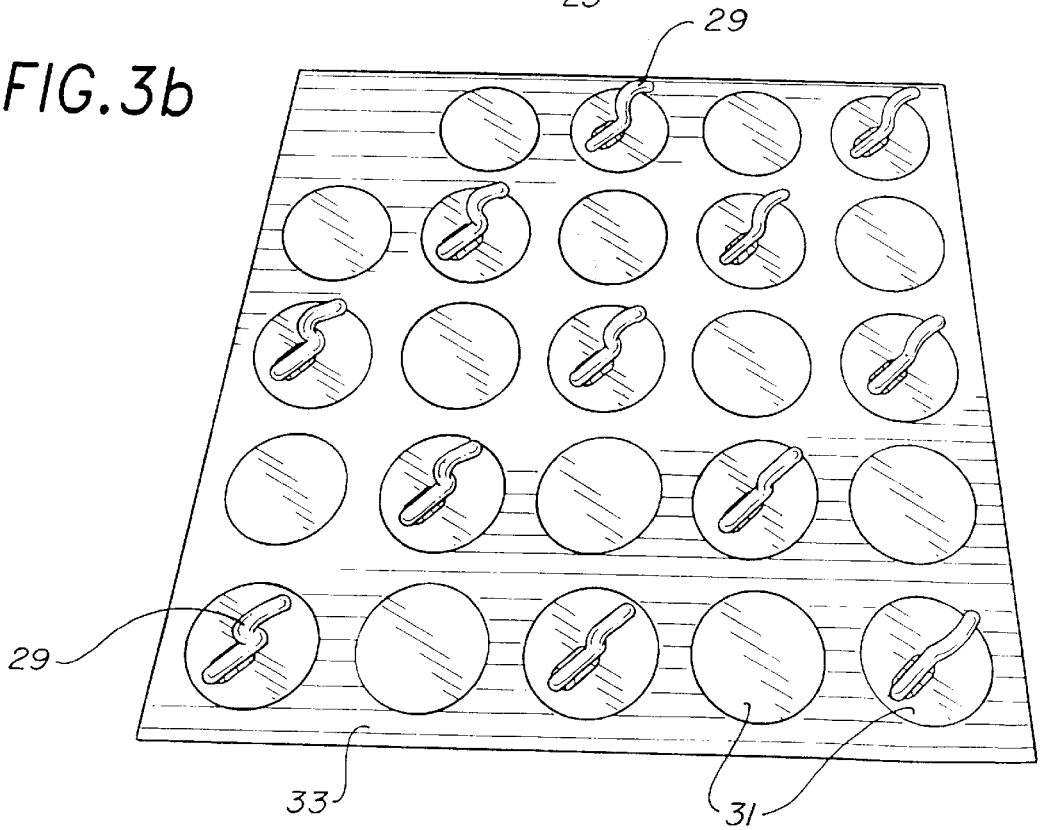
FIG. 3*b* shows a top perspective view of a two-dimensional array of wire hooks on a substrate which align and hook with the smaller wire loops of the two-dimensional array shown in FIG. 3*a*.

FIG. 3*b* shows a top perspective of an array of conductive wire hooks 29 mounted on electrical contact pads 31 on substrate 33. As can be seen, the hooks are mounted on alternate contact pads 31. As also can be seen, the hook portion of hooks 29 bend toward the plane of substrate 33. The hooks 29 on substrate 33 in FIG. 3*b* are designed to mate with smaller loops 25 on substrate 23 in FIG. 3*a* when substrate 33 is turned over. Similarly, the empty contact pads 31 on substrate 33 in FIG. 3*b* are designed to align and make contact with the larger loops 27 on substrate 23 in FIG. 3*a* Thus, when substrate 33 in FIG. 3*b* is turned over and aligned above substrate 23 in FIG. 3*a*, assembly is achieved by depressing substrate 33 so that the empty contact pads 31 in FIG. 3*b* depress against and compress the larger springs 27 in FIG. 3*a*. Substrate 33 is depressed to a point where hooks 29 on substrate 33 may engage the smaller loops 25 in FIG. 3*a* by lateral movement of one of the substrates with respect to the other. After engagement and release of the external depression force, the larger loops 27 provide sufficient compressive force against the substrates so as to keep the hooks engaged with the smaller loops and electrical connection is made between all of the respective contact points on each substrate.

As described previously with regard to FIGS. 1 and 2, any of a variety of wire sizes, materials and connection techniques may be used to form the loops and hooks in FIG. 3*a* and FIG. 3*b*, depending upon the particular packaging application. Considering the degree of flatness of the components and the amount of thermal expansion compliance required for a give packaging application, taken along with the density of connection points and material type, loops and hooks would typically be formed from metal wire having a diameter in the range of 2% to 15% of the spacing between the electrical contact points. For arrays on 1.27 millimeter spacing, this would correspond to 0.025 millimeter to 0.19 millimeter. Metal shapes which are substantially rectangular in crosssection would typically have widths and heights corresponding to similar percentages of the electrical contact point spacing for formed metal. Structures formed from thin film depositions would typically have widths of 20 to 95% of the electrical contact spacing, and have heights with 1% to 15% of the electrical contact spacing.

Although the figures have shown loops or compressive member and hooks or tensile members arranged alternately in arrays, it is clear that other arrangements could as readily be used as long as the distribution of compressive and tensile forces over the surface of the components connected are sufficiently uniform so as to prevent damage through fracture and the like. In this regard, the subareas over which the compressive forces and tensile forces are distributed may be viewed as cells and the connector taught in accordance with the present invention a cellforce connector.

After applying a downward force on the upper substrate, a sideways force then causes the hooks to slide into the small loops. Disengagement can be achieved by applying a downward force sufficient to allow the engaged hooks to clear the small loops and then one substrate is slid sideways with respect to the other.

As can be seen in FIG. 3*b*, alternate rows of large loops and small loops on one substrate intermesh one another with the hooks engaged into the small loops. Each large loop acts as a spring to compress against its respective electrical contact pads 31 on the opposing substrate surface to make electrical connection through each spring. Thus, each engaged hook-loop tensile member and each large loop compressive member makes an electrical connection between substrates while at the same time, acting as one of the cellforce cells of force, holding the substrates securely between opposing forces, resisting movement in any direction, so that continuous electrical connections are maintained.

Figure 4B:
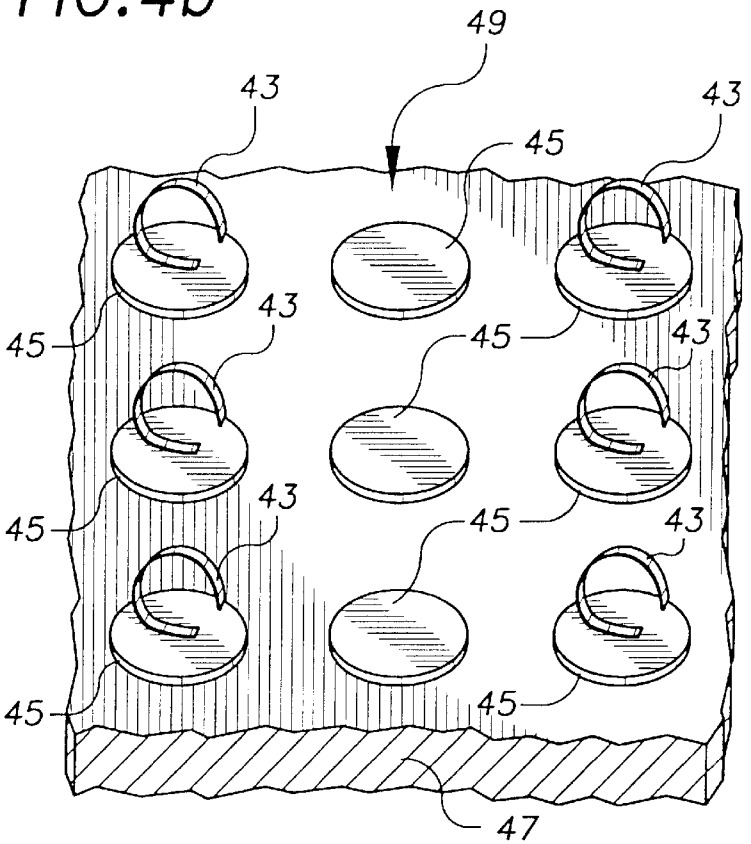
FIG. 4*b* shows a top perspective view of a two-dimensional array of C-shaped hooks made of rectangular cross-section metal which hooks align with and engage the smaller hooks in the two-dimensional array shown in FIG. 4*a*.
Figure 4A:
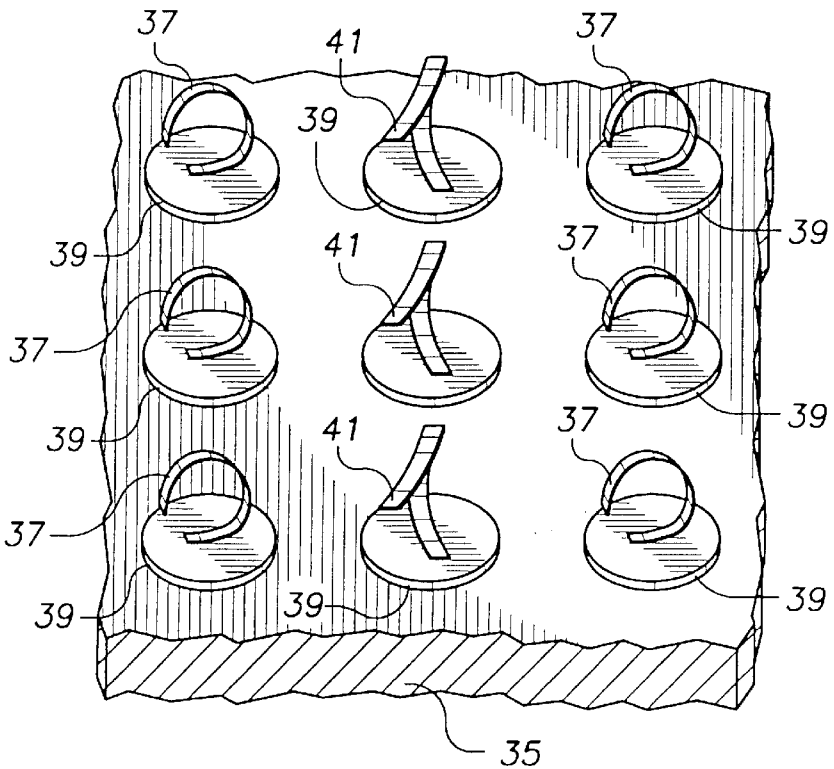
FIG. 4*a* shows a top perspective view of a two-dimensional array of C-shaped hooks made of rectangular cross-section metal.

FIG. 4*a* and FIG. 4*b* show perspective views of the cellforce connector in accordance with the present invention wherein C-shaped hooks, used for both the compressive and tensile connection members, are made of a conductive material having a rectangular cross-section. With reference to FIG. 4*a*, a section of substrate 35 is shown with columns of tensile hooks 37 interposed with columns of larger compressive hooks 41 with each of the various hooks mounted on contact pads 39. With reference to FIG. 4*b*, an opposing section of substrate 47 is shown with columns of tensile hooks 43 mounted on contact pads 45 so as to mate with tensile hooks 37 in FIG. 4*a* when the opposing substrates are engaged. FIG. 4*b* also shows a column at 49 of pads 45 interposing the columns of tensile hooks 43 which pads make contact with compressive hooks 41 in FIG. 4*a* when the opposing substrates are engaged. The smaller tensile hooks 37 and 43 may be proportioned to be about half the size of the larger compressive hooks 41. The opposing substrates are engaged in a manner similar to that described with respect to FIGS. 3*a* and 3*b* wherein the substrates are compressed together and move laterally with respect to one another so that the columns of tensile hooks 37 on substrate 35 engage the columns of tensile hooks 43 on substrate 47 to lock the substrates together. As is clear, compressive hooks 41 on substrate 35 are then in compression and in conductive contact with the center column of pads 45 on substrate 47.

Although FIGS. 4*a* and 4*b* show columns of tensile hooks and columns of compressive hooks, it is clear that other arrangements could as readily be used. For example, compressive and tensile hooks could be mounted in alternate fashion in each column, similar to the loop arrangement shown in FIGS. 3*a* and 3*b*. It is also clear that any number of columns and rows may be used, depending upon the particular application. The arrangement in FIGS. 4*a* and 4*b* is given to show that compressive and tensile members may also be made of conductive material, such as tungsten, molybdenum, superelastic nickel-titanium, copper, or bronze, which has a rectangular cross-section. The dimensions of the cross-section are selected in accordance with the particular conductive material used, the size of the hooks employed, spacing between hooks and the requirements of imposing a force over a range of distances for the particular application.

Among the various advantages of achieving electrical connection by mechanically coupling without bonding, soldering, welding or the like is that such an approach allows electronic devices to be mounted and demounted and then remounted at room temperature. This greatly simplifies electrical diagnostics for multicomponent applications. The components of a "tested bad" multicomponent assembly can be individually swapped with the corresponding component of a "tested good" multicomponent assembly. The bad components can be identified without the complex electrical diagnostics typically needed to isolate problems in multicomponent assemblies. In addition, such an approach overcomes the problems of fatigue breakdown inherent in connection processes that use bonding, soldering, welding or the like.

It should be clear that any spring-like shape may be used to achieve the same results, i.e. electrical connection via the internal mechanical attachment means used to hold the electrically connected electronic devices together with opposing forces over a range of distances in an electronic package. In this regard, use of the term substrate made in the various descriptions of embodiments of the present invention should be taken to mean the medium used to support electronic components in any level of electronic packaging.

It will be understood from the foregoing description that various modifications and changes may be made in the preferred embodiment of the present invention without departing from its true spirit. It is intended that this description is for purposes of illustration only and should not be construed in a limiting sense. The scope of this invention should be limited only by the language of the following claims.

What is claimed is:

1. A cellforce electrical connector including at least one connector-pair electrically connecting first and second electronic devices comprising, a conductive tensile member as one connector of said connector-pair and a conductive compressive member as the other connector of said connector-pair, said tensile member acting to provide a conductive path between said first and second electronic devices and tensile force to hold said devices together and said compressive member acting to provide a conductive path between said first and second electronic devices and compressive force to balance said tensile force.

2. The connector as set forth in claim 1 wherein said at least one connector-pair comprises an array of connector-pairs.

3. The connector as set forth in claim 2 wherein said tensile member and said compressive member each act to impose force on said first and second electronic devices over a range of distances so as to maintain continuous electrical contact between said first and second electronic devices.

4. The connector as set forth in claim 3 wherein said tensile member comprises a tensile conductive hook and a tensile conductive loop, one mounted on said first electronic device and the other mounted on said second electronic device so as to engage one another and said compressive member comprises a single conductive loop electrically connecting said first and second electronic devices.

5. The connector as set forth in claim 4 wherein said single conductive loop and said tensile conductive loop are each conductive hooks.

6. The connector as set forth in claim 4 wherein said tensile conductive hook and said conductive loops are made of round wire.

7. The connector as set forth in claim 4 wherein said tensile conductive hook and said conductive loops are each made of conductive material with a rectangular cross-section.

8. The connector as set forth in claim 6 wherein said wire is made of molybdenum.

9. The connector as set forth in claim 6 wherein said wire is made of tungsten.

10. The connector as set forth in claim 6 wherein said wire is made of superelastic nickel-titanium.

11. The connector as set forth in claim 6 wherein said wire is made of precipitation hardened copper.

12. The connector as set forth in claim 6 wherein said wire is made of phosphor bronze.

13. The connector as set forth in claim 7 wherein said conductive material with rectangular cross-section is made of molybdenum.

14. The connector as set forth in claim 7 wherein said conductor material with rectangular cross-section is made of tungsten.

15. The connector as set forth in claim 7 wherein said conductive material with rectangular cross-section is made of superelastic nickel-titanium.

16. The connector as set forth in claim 7 wherein said conductive material with rectangular cross-section is made of precipitation hardened copper.

17. The connector as set forth in claim 7 wherein said conductive material with rectangular cross-section is made of phosphor bronze.

18. An electrical connector for respectively connecting a plurality of electrical contacts on one device to a corresponding plurality of electrical contacts on another device, comprising:

a plurality of conductive tensile members each having at least two ends with one end of respective ones of said plurality of conductive tensile members connected to respective ones of said plurality of electrical contacts on said one device and with the other end of respective ones of said plurality of conductive tensile members connected to respective ones of said plurality of electrical contacts on said another device, said tensile members acting to provide both electrical connection between the respective contacts to which they are connected and tensile force over a range of distances to hold said devices together; and a plurality of conductive compression members each having at least two ends with one end of respective ones of said plurality of conductive compression members connected to those respective ones of said plurality of electrical contacts on said one device that are not already connected to one of said tensile members and the other end of respective ones of said plurality of conductive compression members connected to respective ones of said plurality of electrical contacts on said another device that are not already connected to one of said tensile members, said compressive members acting to provide both electrical connection between the respective contacts to which they are connected and compressive force between said devices over a range of distances to balance said tensile force.

19. The connector as set forth in claim 18 wherein said plurality of conductive tensile members each include tensile loops and said plurality of conductive compression members each include compressive loops.

20. The connector as set forth in claim 19 wherein each of said conductive tensile members comprises two conductive tensile hooks, one affixed to said one device and the other affixed to said another device.

21. The connector as set forth in claim 20 wherein each of said conductive tensile hooks are engaged to mechanically hold said one device and said another device together and at the same time provide an electrical connection therebetween.

22. The connector as set forth in claim 21 wherein each of said compression loops are compression hooks.

23. The connector as set forth in claim 21 wherein each of said conductive tensile hooks and each of said conductive compression loops are round conductive wire.

24. The connector as set forth in claim 21 wherein each of said conductive tensile hooks and each of said conductive compression loops are substantially rectangular in cross-section.

25. The connector as set forth in claim 23 wherein said wire is molybdenum.

26. The connector as set forth in claim 23 wherein said wire is tungsten.

27. The connector as set forth in claim 23 wherein said wire is superlastic nickel-titanium.

28. The connector as set forth in claim 23 wherein said wire is precipitation hardened copper.

29. The connector as set forth in claim 23 wherein said wire is phosphor bronze.

30. The connector as set forth in claim 24 wherein said conductive tensile hooks and said conductive compression loops are made of molybdenum.

31. The connector as set forth in claim 24 wherein said conductive tensile hooks and said conductive compression loops are made of tungsten.

32. The connector as set forth in claim 24 wherein said conductive tensile hooks and said conductive compression loops are made of superelastic nickel-titanium.

33. The connector as set forth in claim 24 wherein said conductive tensile hooks and said conductive compression loops are made of precipitation hardened copper.

34. The connector as set forth in claim 24 wherein said conductive tensile hooks and said conductive compression loops are made of phosphor bronze.

35. The connector as set forth in claim 21 wherein said tensile hooks are mechanically disengaged to separate said one device and said another device.

36. An electrical connector for respectively connecting a plurality of electrical contacts on one device to a corresponding plurality of electrical contacts on another device, comprising:

a plurality of conductive tensile members each having at least one end and another end with said one end of respective ones of said plurality of conductive tensile members connected to respective ones of said plurality of electrical contacts on said one device and with said another end of respective ones of said plurality of conductive tensile members connected to respective ones of said plurality of electrical contacts on said another device, said tensile members acting to provide both electrical connection between the respective contacts to which they are connected and tensile inward force over a range of distances to hold said devices together; and a plurality of nonconductive compression members each having at least one end and another end with said one end of respective ones of said plurality of nonconductive compression members connected to the nonconductive areas adjacent to the respective ones of said plurality of electrical contacts on said one device that are connected to the said one end of said tensile members and with said another end of respective ones of said plurality of nonconductive compression members connected to the nonconductive areas adjacent to the respective ones of said plurality of electrical contacts on said another device that are connected to the said another end of said tensile members, said compressive members acting to provide compressive outward force between said devices over a range of distances to balance said tensile inward force.

37. The connector as set forth in claim 36 wherein said plurality of conductive tensile members each include a tensile hook and a tensile loop.

38. The connector as set forth in claim 37 wherein each of said conductive tensile members including tensile loops comprises two conductive tensile hooks, one affixed to said one device and the other affixed to said another device.

39. The connector as set forth in claim 38 wherein each of said conductive tensile hooks are engaged to mechanically hold said one device and said another device together and at the same time provide an electrical connection therebetween.

40. The connector as set forth in claim 36 wherein each of said nonconductive compression members is a column.

41. The connector as set forth in claim 36 wherein each of said nonconductive compression members is a portion of a perforated elastically compressible sheet containing a plurality of perforations through which one or more of said plurality of conductive tensile members respectively pass.

42. The connector as set forth in claim 37 wherein each of said conductive tensile loops is round conductive wire.

43. The connector as set forth in claim 37 wherein each of said conductive tensile loops is substantially rectangular in cross-section.

44. The connector as set forth in claim 40 wherein said column is rubber.

45. The connector as set forth in claim 41 wherein said sheet is rubber.

46. The connector as set forth in claim 39 wherein said tensile hooks are mechanically disengaged to separate said one device and said another device.

47. An electrical connector for connecting an array of contact points on one device to a corresponding array of contact points on an another device, comprising:

a plurality of conductive tensile members each having two ends with one end of respective ones of said tensile members connected to respective ones of said contact points on said one device and the other end of respective ones of said tensile members connected to respective ones of said contact points on said another device, said plurality of conductive tensile members being less in number that the number of contact points on said one device and said another device;

a plurality of conductive compressive members each having two ends with one end of respective ones of said compressive members connected to respective ones of at least some of the remainder of said contact points on said one device and the other end of respective ones of said compressive members connected to respective ones of at least some of the remainder of contact points on said another device;

whereby said tensile members act to hold said devices together with tensile force active over a range of distances while said compressive members act to balance said tensile force with a force active over said range of distances.

48. First and second substrates each having an array of electrical contacts to be respectively joined to one another, comprising:

a plurality of tensile members respectively mounted on selected contacts of said array of contacts on said first substrate with each tensile member including a hook arrangement for mechanically engaging another tensile member mounted on corresponding contacts of said array of contacts on said second substrate to provide a tensile force between said first and second substrates over a range of distances and continuous electrical connection between corresponding contacts when engaged; and a plurality of compression members respectively mounted on selected contacts other than those contacts having tensile members mounted thereon with each compression member including spring members which provide a compression force between said first and second substrates over a range of distances and continuous electrical connection between corresponding contacts when engaged.

* * * * *